US008096237B2

(12) United States Patent
Bitterich et al.

(10) Patent No.: US 8,096,237 B2
(45) Date of Patent: Jan. 17, 2012

(54) SYSTEM FOR COATING A PRINTING MATERIAL WITH A FLUID

(75) Inventors: Wolfgang Bitterich, Gemmingen (DE); Jürgen Rothaug, Nußloch (DE); Michael Schwandt, Heidelberg (DE)

(73) Assignee: Heidelberger Druckmaschinen AG, Heidelberger (DE)

( * ) Notice: Subject to any disclaimer, the term of this patent is extended or adjusted under 35 U.S.C. 154(b) by 68 days.

(21) Appl. No.: 12/503,549

(22) Filed: Jul. 15, 2009

(65) Prior Publication Data

US 2010/0018461 A1 Jan. 28, 2010

(30) Foreign Application Priority Data

Jul. 25, 2008 (DE) ..... 10 2008 034 762

(51) Int. Cl.
*B41F 31/00* (2006.01)

(52) U.S. Cl. ..... 101/141; 101/130

(58) Field of Classification Search ..... 101/141, 101/130

See application file for complete search history.

(56) References Cited

U.S. PATENT DOCUMENTS

| | | | | |
|---|---|---|---|---|
| 3,800,702 | A * | 4/1974 | Roberts | 101/425 |
| 3,862,553 | A * | 1/1975 | Schwemmer et al. | 68/15 |
| 3,896,730 | A * | 7/1975 | Garrett et al. | 101/425 |
| 4,534,291 | A * | 8/1985 | Sabota et al. | 101/483 |
| 4,774,884 | A * | 10/1988 | Sugimoto et al. | 101/170 |
| 4,864,925 | A * | 9/1989 | Van Kanegan et al. | 101/141 |
| 5,003,877 | A * | 4/1991 | Yano et al. | 101/363 |
| 6,576,059 | B2 * | 6/2003 | Burgard | 118/683 |
| 6,607,601 | B1 | 8/2003 | Scholzig et al. | |
| 6,752,871 | B2 | 6/2004 | Bitterich et al. | |
| 6,923,121 | B2 * | 8/2005 | De Vroome | 101/488 |
| 7,165,494 | B2 * | 1/2007 | Shields | 101/483 |
| 7,165,495 | B2 * | 1/2007 | Adachi | 101/483 |
| 2003/0121436 | A1 * | 7/2003 | Shields | 101/364 |
| 2005/0103217 | A1 * | 5/2005 | Biasini | 101/425 |

FOREIGN PATENT DOCUMENTS

| | | | |
|---|---|---|---|
| CA | 2378350 | C | 2/2001 |
| DE | 4116989 | A1 | 11/1992 |
| DE | 19902567 | A1 | 8/2000 |
| DE | 19937468 | A1 | 3/2001 |
| DE | 10257373 | A1 | 8/2003 |
| DE | 102007044216 | A1 | 4/2008 |
| EP | 1200261 | B1 | 2/2003 |

OTHER PUBLICATIONS

German Search Report dated Jan. 30, 2009.

* cited by examiner

*Primary Examiner* — Anthony Nguyen
(74) *Attorney, Agent, or Firm* — Laurence A. Greenberg; Werner H. Stemer; Ralph E. Locher

(57) ABSTRACT

A system for coating a printing material with a fluid includes a printing press. The printing press includes a metering apparatus for metering the fluid, which is disposed within the printing press, an intermediate storage container for the intermediate storage of the fluid, which is disposed within the printing press, and a first delivery pump for delivering the fluid from the intermediate storage container to the metering apparatus, which first delivery pump is disposed within the printing press. The metering apparatus, the intermediate storage container and the first delivery pump together form a circuit. A supply storage container stores the fluid and a second delivery pump delivers the fluid from the supply storage container to the intermediate storage container.

7 Claims, 1 Drawing Sheet

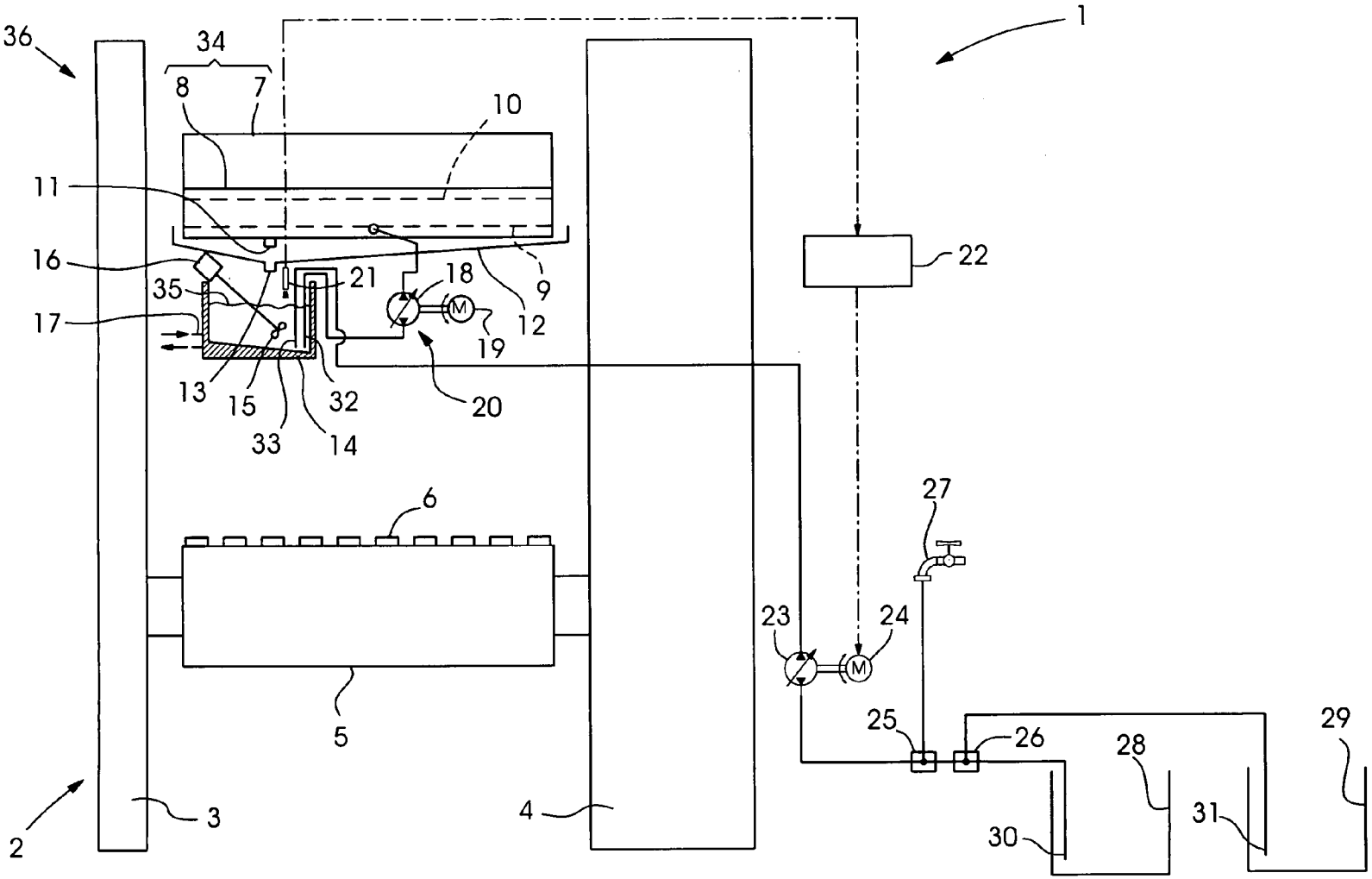
1
2
3
4
5
6
7
8
9
10
11
12
13
14
15
16
17
18
19
20
21
22
23
24
25
26
27
28
29
30
31
32
33
34
35
36

SYSTEM FOR COATING A PRINTING MATERIAL WITH A FLUID

CROSS-REFERENCE TO RELATED APPLICATION

This application claims the priority, under 35 U.S.C. §119, of German Patent Application DE 10 2008 034 762.0, filed Jul. 25, 2008; the prior application is herewith incorporated by reference in its entirety.

BACKGROUND OF THE INVENTION

Field of the Invention

The present invention relates to a system for coating a printing material with a fluid.

Printing materials, for example sheets, are coated with fluids, for example varnishes. To that end, systems are used which include printing presses and so-called peripheral devices. The peripheral devices stand beside the printing press and are connected to the latter through lines and the like.

Such a peripheral device is, for example, a varnish supply unit which is described in German Published, Non-Prosecuted Patent Application DE 102 57 373 A1, corresponding to U.S. Pat. No. 6,752,871 B2. That varnish supply unit includes pumps and selection valves, which are accommodated in a cabinet-like housing of the varnish supply unit.

A varnishing unit having a varnish trough is described in German Published, Non-Prosecuted Patent Application DE 199 02 567 A1. The varnish trough forms a circuit together with a first delivery pump and an intermediate storage container. The varnish can be introduced into the circuit from a supply storage container through the use of a second delivery pump. That system is comparatively complicated to handle.

German Published, Non-Prosecuted Patent Application DE 199 37 468 A1, corresponding to U.S. Pat. No. 6,607,601, describes a varnishing system which includes a supply storage container and an intermediate storage container for the varnish. The varnishing system further includes a pump for delivering the varnish from the supply storage container into the intermediate storage container. In specific operating situations, such as when ending a print job, the supply of the varnish from the supply storage container to the intermediate storage container is interrupted and the pump circulates the varnish within a circuit which is formed by the pump together with the intermediate storage container and a metering apparatus of the printing press. The handling of that varnishing system is cumbersome as well.

A varnishing system which is described in European Patent EP 1 200 261 B1, corresponding to Canadian Patent 2 378 350 C, includes a metering apparatus having a chamber-type doctor, a feed pump and a return pump. The two pumps are integrated into a so-called machine guard system, so that for easy access thereto, only one flap belonging to the machine guard system needs to be opened. Disposed underneath the chamber-type doctor is a so-called holding trough. The feed pump is used to deliver the varnish from a supply storage container into the chamber-type doctor, and the return pump is used to deliver the varnish back from the holding trough into the supply storage container. Although mention is made of some measures which are intended to simplify the handling of the varnishing system, those measures are comparatively complicated.

SUMMARY OF THE INVENTION

It is accordingly an object of the invention to provide an improved system for coating a printing material with a fluid, which overcomes the hereinafore-mentioned disadvantages of the heretofore-known systems of this general type and which is intended to be comparatively uncomplicated and simple to handle.

With the foregoing and other objects in view there is provided, in accordance with the invention, a system for coating a printing material with a fluid. The system comprises a printing press. This printing press includes a metering apparatus for metering the fluid, which is disposed within the printing press, an intermediate storage container for the intermediate storage of the fluid, which is disposed within the printing press, and a first delivery pump for delivering the fluid from the intermediate storage container to the metering apparatus, which first delivery pump is disposed within the printing press. The metering apparatus, the intermediate storage container and the first delivery pump together form a circuit. Furthermore, the system according to the invention includes a supply storage container for storing the fluid and a second delivery pump for delivering the fluid from the supply storage container to the intermediate storage container.

Despite the enhanced functionality of the system according to the invention, this can be implemented by using only two delivery pumps. The system according to the invention exhibits beneficial preconditions for its automation. The fact that the metering apparatus, the intermediate storage container and the first delivery pump are disposed together within the printing press means that the line connecting these components to one another is very short, which in turn means that the residual quantity of the previously used fluid to be disposed of during a change of the fluid can advantageously be kept small. The compact structure permits the construction of the intermediate storage container as a modular unit that can be removed from the printing press by the operator, for example for maintenance purposes.

In accordance with another feature of the invention, the supply storage container is disposed outside the printing press. In contrast to the metering apparatus, the intermediate storage container and the first delivery pump, the supply storage container is therefore not disposed between the machine side frame walls of the printing press. As a result, the supply storage container is easily accessible by the operator and the supply storage container can be a large barrel, for example a varnish drum, which is in turn advantageous with regard to high-edition print jobs with a correspondingly large consumed quantity of fluid.

In accordance with a further feature of the invention, the first delivery pump is disposed downstream of the intermediate storage container, as seen in the delivery direction of the fluid, and the first delivery pump is disposed upstream of the metering apparatus, as seen in the delivery direction of the fluid. As a result of placing the first delivery pump within the line system between the intermediate storage container and the metering apparatus, the latter can have a so-called pressurized chamber-type doctor. Within the chamber of such a pressurized chamber-type doctor, the fluid is under a positive pressure, which can be generated by the first delivery pump. The pressurized chamber-type doctor is advantageous with regard to particularly thorough filling of the cells or grooves of an engraved roll of the metering apparatus with the fluid.

In accordance with an added feature of the invention, a level sensor is provided for monitoring a level formed by the fluid in the intermediate storage container. In this case, there can be a control apparatus for the activation of the second delivery pump, carried out as a function of signals from the level sensor. These developments are advantageous with regard to feeding the intermediate storage container with the fluid from the supply storage container. An excessively low level of the fluid in the intermediate storage container could lead to the first delivery pump sucking in unwanted air, which enters into the metering apparatus and impairs the function of the latter. Through the use of the control apparatus connected to the level sensor, the reaching of a critical lower limit of the level is detected and, as a result, the second delivery pump is switched on or its delivery rate is increased, so that the level in the intermediate storage container is raised again in good time and the complications explained are avoided. An excessively high level of the fluid would involve the risk of the fluid overflowing from the intermediate storage container and the contamination of adjacent machine parts. A control loop including the level sensor and the control apparatus is able to ensure that the feed is interrupted or restricted in good time and, as a result, the overflow is avoided. If the level sensor signals the reaching of a critical upper limit of the level of the fluid in the intermediate storage container, the second delivery pump is switched off or made to run more slowly by the control apparatus. When emptying the pressurized chamber-type doctor, provision can be made for the second delivery pump to be operated in the so-called suction mode—which is to say with a delivery direction opposite to pressure operation—as soon as the level sensor signals the reaching of the critical upper limit of the fluid in the intermediate storage container.

In accordance with an additional feature of the invention, the metering apparatus has a chamber-type doctor, beneath which there is disposed a collecting trough for collecting the fluid running out of the chamber-type doctor, and the intermediate storage container is disposed underneath the collecting trough. The chamber-type doctor can, for example, be the pressurized chamber-type doctor already mentioned previously. The presence of the collecting trough advantageously permits operation of the printing press even without using the intermediate storage container. This operating mode can be used, for example, in the case of print jobs with a large consumption of fluid. The intermediate storage container which is unused when processing such a print job can remain in the printing press or be removed from the latter. In the operating mode, the second delivery pump can be connected to the metering apparatus instead of the intermediate storage container, in order to pump the fluid directly from the supply storage container to the metering apparatus. A further pump can be connected to the collecting trough in order to pump fluid back from the latter into the supply storage container.

In accordance with a concomitant feature of the invention, the intermediate storage container is substantially shorter than the metering apparatus, as seen in the direction of the printing width. The short overall length of the intermediate storage container makes it possible to place the intermediate storage container and the first delivery pump one after the other in the direction of the printing width. This configuration of the intermediate storage container and the first delivery pump, including its motor, substantially in alignment with one another in the longitudinal direction, permits the accommodation of these components in an extremely small overall space. The short length of the intermediate storage container is advantageous not only with regard to the utilization of overall space but also with regard to the reduction in the so-called operating quantity of the fluid and in the cleaning of the intermediate storage container. As a result of the short length of the intermediate storage container, its storage volume is reduced and thus the operating quantity of the fluid and the size of the areas of the intermediate storage container that have to be cleaned are reduced.

Other features which are considered as characteristic for the invention are set forth in the appended claims.

Although the invention is illustrated and described herein as embodied in a system for coating a printing material with a fluid, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWING

The FIGURE of the drawing is a schematic and diagrammatic, front-elevational view of a printing press having the system according to the invention.

DETAILED DESCRIPTION OF THE INVENTION

Referring now in detail to the single FIGURE of the drawing, there is seen a portion of a printing press 1. The printing press 1 is a lithographic offset printing press and includes a varnishing unit 36. Spot varnishing can be produced through the use of the varnishing unit 36, which functions in principle as a flexographic printing unit. A machine frame 2 includes a side wall 3 on the so-called operating side of the printing press 1 and a side wall 4 on the so-called drive side.

A transport apparatus 5 for the transport of the sheets to be coated with a fluid, is disposed between the two side walls 3, 4. The transport apparatus 5 includes grippers 6 disposed in a row to hold the sheet to be coated at its leading edge, which is clamped in the grippers in this case. The transport apparatus 5 is an impression cylinder which, together with a non-illustrated varnishing cylinder, forms a press nip.

The coating fluid, in this case the varnish, is transferred to the varnishing cylinder by an engraved roll 7. A chamber-type doctor 8, which feeds the fluid to the engraved roll 7, rests on the engraved roll 7. The engraved roll 7 and the chamber-type doctor 8 together form a metering apparatus 34 for metering the fluid. The chamber-type doctor 8 has doctor blades 9, 10, between which the non-illustrated chamber is located. A proportion of the fluid not transferred to the engraved roll 7 by the chamber-type doctor 8 escapes from the chamber through a doctor outlet 11.

The fluid flowing out of the doctor outlet 11 passes due to gravitational force delivery into a collecting trough 12, which is disposed underneath the chamber-type doctor 8. The collecting trough 12 is longer than the engraved roll 7 and also longer than the chamber-type doctor 8, as seen in the direction of the printing width, which is to say from the side wall 3 in the direction of the side wall 4. Therefore, the collecting trough 12 is also able to collect leakage of the fluid escaping from the chamber-type doctor 8. The collecting trough 12 has a trough outlet 13, through which the fluid escapes from the collecting trough 12. As can easily be seen in the FIGURE, the trough outlet 13 is placed off-center, specifically more toward the side wall 3. The result is an asymmetric shape of the bottom of the collecting trough 12, falling toward the trough outlet 13 from both sides.

An intermediate storage container 14 is disposed underneath the collecting trough 12 in such a way that the fluid flowing out of the trough outlet 13 as a result of the gravitational force delivery reaches the intermediate storage container 14, which is open at the top. The length of the intermediate storage container 14 to be measured in the direction of the printing width is less than two thirds and preferably less than half of the length of the collecting trough 12 to be measured in the direction of the printing width. Consequently, a liquid surface formed by the fluid in the intermediate storage container 14 is comparatively small, so that the losses of the solvent of the fluid induced by evaporation are also small.

A stirrer mechanism 15, which is disposed in the intermediate storage container 14, has a stirring element in the form of a shaft having a type of propeller at the end of the shaft. This stirring element is driven in rotation by a stirrer mechanism drive 16, which is disposed at the end of the shaft opposite the propeller. The stirrer mechanism drive 16 is an electric motor.

The intermediate storage container 14 has a temperature control apparatus 17 for controlling the temperature of the fluid in the intermediate storage container. The temperature control apparatus 17 makes it possible to lead a gaseous or liquid temperature control substance through the intermediate storage container 14. The temperature control apparatus 17 includes a double-walled construction of the intermediate storage container 14, so that the temperature control substance can flow through its hollow walls. Furthermore, the temperature control apparatus includes an inlet, through which the temperature control substance flows into the intermediate storage container 14, and an outlet, through which the temperature control substance flows out of the intermediate storage container, as indicated in the drawing by arrow symbols. The intermediate storage container 14 can include a non-illustrated container cover, through which the upwardly pointing opening of the intermediate storage container 14 can partly be covered.

The fluid forms a level 35 in the intermediate storage container 14, having a position or height measured and monitored by a level sensor 21. The level sensor 21, disposed above the level 35 and aimed at the fluid in the intermediate storage container 14, is a distance sensor and operates without contact. The level sensor 21 can be an ultrasonic sensor, for example.

The fluid is pumped out of the intermediate storage container 14 into the chamber-type doctor 8 through the use of a first delivery pump 18. The first delivery pump 18 is driven by a pump drive 19, which is an electric motor. A suction line end 32 connected to the first delivery pump 18 opens in the region of a lowest point of the bottom of the intermediate storage container 14. A feed line end 33 of a feed line, which is connected to a second delivery pump 23, also opens in this region. The second delivery pump 23 is equipped with a pump drive 24, which is an electric motor. The two pumps 18, 23 are reversible pumps, which means pumps having a delivery direction that can be reversed. The direction of rotation of the respective pump drive 19 or 24 is reversed in order to change the delivery direction of the respective pump 18, 23.

A supply storage container 28 for the fluid, a so-called varnish container, and a rinsing water container 29, are disposed outside the printing press 1, which is to say not between the two side walls 3, 4 in which the transport apparatus 5 is mounted in such a way that it can rotate. A single so-called suction lance projects into the supply storage container 28 and has an end which forms a suction line end 30. Likewise, only a single suction lance projects into the rinsing water container 29 and has an end forming a suction line end 31. The two suction lances are used to respectively suck the fluid and the rinsing water out of the respective containers 28 and 29. No further line projects into either of the two drum-like containers 28, 29. The second delivery pump 23 can be connected to the supply storage container 28 through selection or multi-way valves 25, 26, in order to pump the fluid out of the supply storage container 28 into the intermediate storage container 14.

A relatively changed control position of the multi-way valves 25, 26 makes it possible to deliver fresh water from a fresh-water connection 27 to the rinsing water container 29. The fresh-water connection 27 is a water tap and the water flowing out from the latter is under pressure, through the use of which it is delivered to the rinsing water container 29 without using an additional pump.

An electronic control apparatus 22 has a control connection to the level sensor 21 and the pump drive 24, so that the control apparatus 22 controls the delivery rate of the second delivery pump 23 as a function of signals from the level sensor 21.

The function of the illustrated system and, in particular, of a circuit 20 for the fluid, which is formed of the intermediate storage container 14, the first delivery pump 18, the chamber-type doctor 8 and the collecting trough 12, will be explained below.

Both fluids with a large consumed quantity and fluids with a small consumed quantity can be printed efficiently by using the illustrated system. A fluid of which a large quantity is consumed during the print job is, for example, a clear varnish. The whole of the offset printed image or a large part thereof is covered by using the clear varnish. The clear varnish or a fluid comparable therewith is supplied to the supply storage container 28. The clear varnish is pumped from the latter into the intermediate storage container 14 through the use of the second delivery pump 23.

Through the use of the temperature control apparatus 17, only the volume of the clear varnish in the intermediate storage container 14 is heated until it has reached the required operating temperature. Consequently, it is not necessary to heat the whole of the volume of fluid in the supply storage container 28. The temperature control apparatus 17 is therefore very energy-efficient. Due to the fact that only the small quantity of the clear varnish in the intermediate storage container 14 needs to be heated and not the large total quantity in the supply storage container 28, clear varnish brought to the operating temperature is already available in the intermediate storage container 14 after a short time. As soon as the level 35 of the clear varnish in the intermediate storage container 14 has risen to a minimum value required for the printing operation, a start of the printing operation can take place.

During the printing operation, the clear varnish is pumped out of the intermediate storage container 14 and into the chamber-type doctor 8 through the use of the first delivery pump 18. The predominant proportion of the clear varnish, not discharged onto the engraved roll 7 from the chamber-type doctor 8, emerges from the doctor outlet 11 and passes through the collecting trough 12 back into the intermediate storage container 14 again, so that the circuit 20 is substantially a closed circuit.

The stirrer mechanism 15 is active not only during printing operation but also during the preceding conditioning of the clear varnish in the intermediate storage container 14.

As a result of the continuing pumping of the clear varnish out of the supply storage container 28 into the intermediate storage container 14, the level 35 in the latter rises slowly until it has reached a maximum permissible value. The reaching of the maximum permissible value is detected by the level sensor 21 and signaled to the control apparatus 22 which, as a reaction to this, deactivates the second delivery pump 23.

Since the feed of varnish into the circuit 20 is no longer carried out but clear varnish is still drawn off from the latter by the engraved roll 7, the level 35 falls until the latter has reached its minimum value once more. The reaching of the minimum permissible value is detected by the level sensor 21 and signaled to the control apparatus 22 which, as a reaction to this, activates the second delivery pump 23 again. The intermediate storage container, the level sensor 21, the control apparatus 22 and the second delivery pump 23 therefore form a closed control loop in the form of a two-state control system.

The rotational speed of the stirrer mechanism 15 can be regulated as a function of the height of the level 35. To this end, the stirrer mechanism drive 16 can have a control connection to the control apparatus 22, so that the latter can control the stirrer mechanism 15 as a function of signals from the level sensor 21.

The illustrated system is operated in a different operating mode when a fluid which is only to be printed in small consumed quantities is to be processed. Such a fluid can be a metal effect ink, for example a gold or silver printing ink. This metal effect ink or the fluid comparable therewith is supplied in a small barrel and is transferred from the latter into the intermediate storage container 14 by hand by the printer. During the processing of the metal effect ink, the use of the second delivery pump 23 is not necessary. Both the initial filling of the intermediate storage container 14 with the metal effect ink and its feed into the intermediate storage container 14 are carried out manually, for example with the aid of a spatula, a ladle or a similar tool.

The control of the temperature and the stirring of the metal effect ink in the intermediate storage container 14 can be carried out in the same way as during the processing of the clear varnish. The level sensor 21 signals to the control apparatus 22 that the maximum permissible value and the minimum value of the level 35 of the metal effect ink in the intermediate storage container 14 required for the printing operation has been reached. If the level sensor 21 signals to the control apparatus 22 that the level 35 has reached the critical lower limit during the course of its lowering caused by consumption, this is then signaled to the printer by the control apparatus 22 through the use of an acoustic or a visual indication. As a result, the printer knows the times at which manual feed of the metal effect ink in the intermediate storage container 14 is necessary. The manual feed of the metal effect ink is therefore a discontinuous feed, exactly like the automatic feed of the clear varnish.

A further operating mode of the illustrated system is a cleaning mode. At the start of the cleaning mode, the fluid is pumped back from the chamber-type doctor 8 into the intermediate storage container 14 through the use of the first delivery pump 18. For this purpose, the direction of rotation of the pump drive 19 and thus the delivery direction of the first delivery pump 18 are set opposite to the direction of rotation and delivery direction during the printing operation. Following the emptying of the chamber-type doctor 8, the intermediate storage container 14 together with the stirrer mechanism 15 and the temperature control apparatus 17 can be removed from the printing press 1, in order to be cleaned and maintained in an easily accessible position outside the printing press 1.

In the case of processing the clear varnish, the latter can be pumped back out of the intermediate storage container 14 into the supply storage container 28 through the use of the second delivery pump 23. For this purpose, the direction of rotation of the pump drive 24 and thus the delivery direction of the second delivery pump 23 are reversed as compared with the printing operation. The multi-way valve 26 is then switched to a control position in which the connection between the suction line 30 in the supply storage container 28 and the second delivery pump 23 is blocked.

In this case, by selecting appropriate control positions of the multi-way valves 25, 26, either the rinsing water container 29 or the fresh-water connection 27 can be connected to the second delivery pump 23, so that the latter, following renewed reversal of its delivery direction, fills the intermediate storage container 14 with rinsing water from the rinsing water container 29 or with fresh water from the fresh-water connection 27 or first with one and then with the other. During this filling of the intermediate storage container 14 with water, the reaching of a maximum level is detected by the level sensor 21 and signaled to the control apparatus 22, which consequently switches off the second delivery pump 23. The rinsing or fresh water that is put into the circuit 20 is circulated in the circuit 20 through the use of the first delivery pump 18 in order to clean the components forming this circuit 20.

During this cleaning of the circuit 20, the temperature control device 17 can be used to heat the water and, as a result, to increase the cleaning action. As a result of the increased temperature of the circulating water, the viscosity of the fluid residues (varnish or printing ink residues) coming into contact with the water is reduced, which means that these fluid residues are detached better from the components of the circuit 20. In order to intensify the cleaning of the intermediate storage container 14 and the stirrer mechanism 15, the latter can be operated during the cleaning, therefore during the circulation of the rinsing and/or fresh water. In this case, the rotational speed of the stirrer mechanism 15 can be regulated as a function of the level, as in the case of its operation during printing operation.

The water in the chamber-type doctor 8, contaminated by the fluid residues after the circulation phase, can be pumped back out of the doctor into the intermediate storage container 14 by the first delivery pump 18 and, after that, out of the intermediate storage container 14 into the rinsing water container 29 by the second delivery pump 23. The intermediate storage container 14 can then be filled again with rinsing water or with fresh water, which is circulated in the circuit 20. In order to effect particularly thorough cleaning, a sequence of a number of water circulation phases with intermediate changing of the water in the circuit 20 can be provided.

It is worth recommending firstly to arrange for the rinsing water from the rinsing water container 29 to circulate in the circuit 20 and then to have the fresh water from the fresh-water connection 27 circulate in the circuit 20. Through the use of appropriate switching of the second delivery pump 23 and the multi-way valves 25, 26, it is likewise possible to pump fresh water from the fresh-water connection 27 into the circuit 20, in which the fresh water is then circulated through the use of the first delivery pump 18, and to pump the fresh water out of the circuit 20 into the rinsing water container 29 after this circulation.

Finally, further advantages of the illustrated system should be pointed out. The pipe-like or hose-like lines which connect the chamber-type doctor 8 to the intermediate storage container 14 have a length which is very short and, for example, is only 0.5 m, which means that the residual quantity of the fluid which has to be removed from these lines during the cleaning is kept small. The system can be combined with an additional supply unit, for example the supply unit described in German Published, Non-Prosecuted Patent Application DE 102 57 373 A1, corresponding to U.S. Pat. No. 6,752,871 B2. For this purpose, it is merely necessary to detach the line connecting the first delivery pump 18 to the chamber-type doctor 8 from the chamber-type doctor 8 and to connect the feed line of the additional supply unit to the chamber-type doctor 8 and also to connect the outlet line of the additional supply unit to the trough outlet 13.

The intermediate storage container 14, including its stirrer mechanism 15, and the first delivery pump 18, including its pump drive 19, can remain in their operating position within the printing press 1 during a printing operation mode in which the chamber-type doctor 8 is supplied with printing ink, varnish or a corresponding fluid by the additional supply unit. This is advantageous with regard to a change of the fluid to be printed between two successive print jobs, for example if, in the preceding print job, the chamber-type doctor is supplied with a varnish from the additional supply unit and, during the following print job, the chamber-type doctor 8 is to be supplied with a different varnish from the intermediate storage container 14. The fact that the components of the circuit 20 remain in their installed position during the use of the additional supply unit means that the conversion of the fluid supply carried out between the print jobs can be performed very quickly.

The invention claimed is:

1. A system for coating a printing material with a fluid, the system comprising:

a) a printing press having:

aa) a metering apparatus with a chamber-type doctor for metering the fluid, said metering apparatus disposed within said printing press;

ab) a collecting trough disposed beneath said chamber-type doctor for collecting the fluid running out of said chamber-type doctor;

ac) an intermediate storage container disposed underneath said collecting trough for intermediate storage of the fluid, said intermediate storage container disposed within said printing press;

ad) a first delivery pump for delivering the fluid from said intermediate storage container to said metering apparatus, said first delivery pump disposed within said printing press;

ae) said metering apparatus, said intermediate storage container and said first delivery pump together forming a circuit;

b) a supply storage container for storing the fluid; and c) a second delivery pump for delivering the fluid from said supply storage container to said intermediate storage container.

2. The system according to claim 1, wherein said supply storage container is disposed outside said printing press.

3. The system according to claim 1, wherein said first delivery pump is disposed downstream of said intermediate storage container and upstream of said metering apparatus, in delivery direction of the fluid.

4. The system according to claim 1, which further comprises a level sensor for monitoring a level formed by the fluid in said intermediate storage container.

5. The system according to claim 4, which further comprises a control apparatus for activation of said second delivery pump as a function of signals from said level sensor.

6. The system according to claim 1, wherein said intermediate storage container is substantially shorter than said metering apparatus, in printing width direction.

7. A system for coating a printing material with a fluid, the system comprising:

a) a printing press having:

aa) a metering apparatus with a chamber-type doctor for metering the fluid, said chamber-type doctor having a doctor outlet, said metering apparatus disposed within said printing press;

ab) a collecting trough disposed beneath said chamber-type doctor for collecting the fluid running out of said doctor outlet due to gravitational force delivery;

ac) an intermediate storage container disposed underneath said collecting trough for intermediate storage of the fluid, said intermediate storage container disposed within said printing press;

ad) a first delivery pump for delivering the fluid from said intermediate storage container to said metering apparatus, said first delivery pump disposed within said printing press;

ae) said metering apparatus, said intermediate storage container and said first delivery pump together forming a circuit;

b) a supply storage container for storing the fluid; and c) a second delivery pump for delivering the fluid from said supply storage container to said intermediate storage container.

* * * * *